US010661317B1

(12) United States Patent
Conway

(10) Patent No.: US 10,661,317 B1
(45) Date of Patent: May 26, 2020

(54) VEHICLE MOUNTED GARBAGE BIN CLEANING SYSTEM INCLUDING POWER TAKEOFF

(71) Applicant: SPARKLING BINS, LLC, Miami, FL (US)

(72) Inventor: John Conway, Miami, FL (US)

(73) Assignee: SPARKLING BINS, LLC, Miami, FL (US)

( * ) Notice: Subject to any disclaimer, the term of this patent is extended or adjusted under 35 U.S.C. 154(b) by 0 days.

(21) Appl. No.: 16/428,516

(22) Filed: May 31, 2019

Related U.S. Application Data

(63) Continuation-in-part of application No. 16/235,577, filed on Dec. 28, 2018.

(51) Int. Cl.

| | |
|---|---|
| ***B08B 9/093*** | (2006.01) |
| ***B65F 7/00*** | (2006.01) |
| ***B08B 9/08*** | (2006.01) |

(52) U.S. Cl.

CPC ..... *B08B 9/0936* (2013.01); *B08B 9/0826* (2013.01); *B08B 9/0933* (2013.01); *B65F 7/005* (2013.01); *B08B 2203/0264* (2013.01); *B08B 2209/08* (2013.01)

(58) Field of Classification Search

CPC .... B65F 7/00; B65F 7/005; B65F 2003/0223; B65F 2003/0226; B65F 2003/023; B08B 9/08; B08B 9/0804; B08B 9/0813; B08B 9/0821; B08B 9/0826; B08B 9/093; B08B 9/0936; B08B 9/20; B08B 9/205; B08B 9/28; B08B 9/34; B08B 9/42; B08B 2209/08

See application file for complete search history.

(56) References Cited

U.S. PATENT DOCUMENTS

| | | | | |
|---|---|---|---|---|
| 3,372,875 | A * | 3/1968 | Torrey | B65F 7/005 239/129 |
| 3,604,577 | A * | 9/1971 | Heilmeier | B60P 1/483 414/421 |
| 2001/0046430 | A1* | 11/2001 | Bayne | B65F 1/1452 414/408 |
| 2008/0110476 | A1* | 5/2008 | Amestoy | B08B 9/0936 134/34 |
| 2010/0170537 | A1* | 7/2010 | Gingras | B08B 9/0826 134/18 |
| 2012/0125364 | A1* | 5/2012 | Wiley | B08B 9/0936 134/10 |
| 2014/0144470 | A1* | 5/2014 | Sewell | B01F 3/04503 134/18 |

* cited by examiner

*Primary Examiner* — David G Cormier
(74) *Attorney, Agent, or Firm* — Mark Terry

(57) ABSTRACT

A vehicle mounted garbage bin cleaning system including power takeoff includes a pair of arms configured for lifting a garbage bin, the pair of arms rotatably coupled to a mount on the vehicle, a hopper configured for accepting the garbage bin when the pair of arms lifts the garbage bin into the hopper, at least one spray rod extending upwards from the hopper, said spray rod including a water nozzle, wherein when the pair of arms lifts the garbage bin into the hopper, the spray rod is situated within the garbage bin, a hydraulic pump mechanically coupled with a transmission of the vehicle, such that the transmission drives the hydraulic pump, a hydraulic motor hydraulically coupled with the hydraulic pump, a pressure washer pump mechanically coupled to the hydraulic motor, the spray rod fluidically coupled with the pressure washer pump.

19 Claims, 13 Drawing Sheets

VEHICLE MOUNTED GARBAGE BIN CLEANING SYSTEM INCLUDING POWER TAKEOFF

CROSS-REFERENCE TO RELATED APPLICATIONS

This patent application is a continuation in part of, and claims priority to, patent application Ser. No. 16/235,577 filed Dec. 28, 2018 and titled "Vehicle Mounted Garbage Cleaning System." The subject matter of patent application Ser. No. 16/235,577 is hereby incorporated by reference in its entirety.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The technical field relates generally to garbage bin cleaning systems and, more specifically, to vehicle mounted garbage bin cleaning systems for thoroughly cleaning and deodorizing garbage bins in a highly automated manner.

BACKGROUND

Sanitation is a critical feature in any society, as it is a requirement for providing desirable living conditions. Sanitation being improperly performed can and does lead to sickness and even death on a massive scale. To this end, the disposal of garbage from commercial establishments, residential homes and apartment houses is generally handled by garbage trucks equipped to handle garbage bins. These trucks have the capability of lifting the bins and dumping the contents thereof into a compactor from where the compacted trash is pushed by a ram into the back of the truck for dumping. Particularly in the case of restaurants and apartment houses where the trash contains a considerable amount of organic material, the garbage bins may become unpleasantly odorous, even after having been emptied, and can present a health problem.

The current solutions for washing and disinfecting garbage bins are largely unacceptable. Manually washing and disinfecting garbage bins can be time consuming and tedious for a person to perform, as well a labor intensive. Automated processes may be employed, such as through the use of tank trucks equipped with a hoisting device and a separate pump unit adapted to provide water jets for sprinkling the interior walls of the garbage bin, with the bin being suspended from the hoisting device. The automated processes, however, are usually limited in scope as the tank truck and hoisting device are usually limited to garbage bins of a particular size, thereby leaving a large amount of garbage bins of differing sizes unattended. Conventional automated processes for washing and disinfecting garbage bins can also leave many interior areas of a garbage bin being untouched, with a large proportion of the dirt stubbornly adhering on the garbage bin walls. The known automated processes may also use exorbitant amounts of water per garbage bin, thereby resulting in large amounts of water waste. Conventional automated processes for washing and disinfecting garbage bins may further cause runoff of the wastewater into the environment, which can be damaging.

Furthermore, some of the conventional automated processes for washing and disinfecting garbage bins are inefficient, as they require one or more separate gas engines to power the water pumps that provide pressurized water to the spraying system. The requirement of additional engines introduces inefficiencies into the system, including additional maintenance requirements for the additional engines, additional fuels costs, additional points of failure that increase downtime of the system, and additional repairs. These inefficiencies increases overall cost and time requirements for said conventional automated processes and are therefore disadvantageous.

Therefore, a need exists for improvements over the prior art, and more particularly for improved systems and apparatuses for quickly and efficiently performing a proper cleaning and disinfecting regimen for garbage bins.

SUMMARY

A vehicle mounted garbage bin cleaning system including power takeoff is provided. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, the vehicle mounted garbage bin cleaning system including power takeoff includes a pair of arms configured for lifting a garbage bin, the pair of arms rotatably coupled to a mount on the vehicle, a hopper configured for accepting the garbage bin when the pair of arms lifts the garbage bin into the hopper, at least one spray rod extending upwards from the hopper, said spray rod including at least one high-pressure, rotating water nozzle that sprays a water jet, wherein when the pair of arms lifts the garbage bin into the hopper, the at least one spray rod is situated within the garbage bin, and a power takeoff driven pressure washing system comprising: 1) a hydraulic pump mechanically coupled with a transmission of the vehicle, such that the transmission drives the hydraulic pump; 2) a hydraulic motor hydraulically coupled with the hydraulic pump, such that the hydraulic pump drives the hydraulic motor; 3) a pressure washer pump mechanically coupled to the hydraulic motor such that the hydraulic motor drives the pressure washer pump; and 4) the at least one spray rod fluidically coupled with the pressure washer pump such that pressure washer pump provides pressurized water to the at least one spray rod.

In another embodiment, the vehicle mounted garbage bin cleaning system including power takeoff includes a pair of arms configured for lifting a garbage bin, the pair of arms rotatably coupled to a mount on the vehicle, a hopper configured for accepting the garbage bin when the pair of arms lifts the garbage bin into the hopper, at least two spray rods extending upwards from the hopper, each of said spray rods including at least one high-pressure, rotating water nozzle that sprays a water jet, wherein when the pair of arms lifts the garbage bin into the hopper, the at least one spray rod is situated within the garbage bin, and, a power takeoff driven pressure washing system comprising: 1) a first hydraulic pump mechanically coupled with a transmission of the vehicle, and a second hydraulic pump mechanically coupled with the transmission, such that the transmission drives the first and second hydraulic pumps; 2) a first hydraulic motor hydraulically coupled with the first hydraulic pump, such that the first hydraulic pump drives the first hydraulic motor, and a second hydraulic motor hydraulically coupled with the second hydraulic pump, such that the second hydraulic pump drives the second hydraulic motor; 3) a first pressure washer pump mechanically coupled to the first hydraulic motor such that the first hydraulic motor drives the first pressure washer pump, and a second pressure washer pump mechanically coupled to the second hydraulic motor such that the second hydraulic motor drives the second pressure washer pump; and 4) a first of the at least two spray rods fluidically coupled with the first pressure washer pump such that first pressure washer pump provides pressurized water to the first of the at least two spray rods, and a second of the at least two spray rods fluidically coupled with the second pressure washer pump such that second pressure washer pump provides pressurized water to the second of the at least two spray rods.

BRIEF DESCRIPTION OF THE DRAWINGS

The accompanying drawings, which are incorporated in and constitute a part of this disclosure, illustrate various example embodiments. In the drawings.

DETAILED DESCRIPTION

Figure 1A:
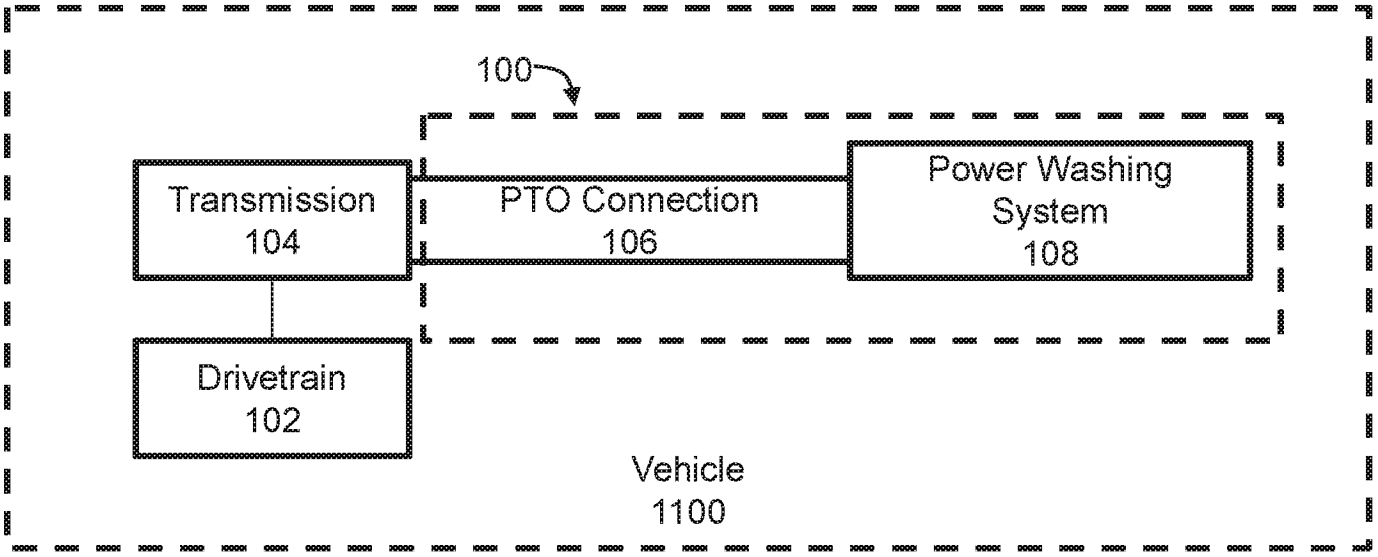
FIG. 1A is a drawing depicting a block diagram of the power takeoff driven pressure washing system of the vehicle-mounted garbage bin cleaning system, according to an example embodiment.

The following detailed description refers to the accompanying drawings. Wherever possible, the same reference numbers are used in the drawings and the following description to refer to the same or similar elements. While embodiments may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the claimed subject matter. Instead, the proper scope of the claimed subject matter is defined by the appended claims.

The claimed subject matter improves over the prior art by providing a simple, cost-effective and efficient vehicle-mounted garbage bin cleaning system configured for cleaning both large and small garbage bins, such as dumpsters and recycling bins. The claimed subject matter improves sanitation by allowing for larger number of large and small garbage bins to be cleaned at the curbside in smaller amounts of time, using a minimum of labor or manual user involvement. The claimed subject matter is particularly useful in the case of restaurants and apartment houses where the trash contains a considerable amount of organic material.

The claimed subject matter further improves over the prior art by providing an efficient system that does not require separate gas engines to power the water pumps that provide pressurized water to the spraying system. The elimination of additional engines removes inefficiencies such as additional maintenance requirements for the additional engines, additional fuels costs, additional points of failure that increase downtime of the system, and additional repairs. The removal of these inefficiencies decreases overall cost and time requirements for said claimed subject matter and are therefore advantageous.

The claimed subject matter also improves over the prior art by providing a system that allows for the pressure washing of more than one garbage bin at once. Conventional systems that use a separate or independent gas-powered pump only have enough power to operate one pressure washing pump at a time, and therefore only washing one garbage bin at a time. This limits the throughput of the system. By using a much more powerful power takeoff powered pressure washing system, the claimed subject matter allows for the pressure washing or more than one garbage bin at a time, thereby increasing the throughput of the system, in addition to increasing the volume of garbage bins that can be washed in a given period of time.

The claimed subject matter also improves over the prior art by using a simple automated process that is large in scope as garbage bins of a variety of sizes may be cleaned by the claimed system without requiring adapters or other adjustment of the system. The claimed subject matter also thoroughly washes and disinfects garbage bins without using exorbitant amounts of water per garbage bin, thereby resulting in aa reduction of water waste. The claimed subject matter also does no cause runoff of the wastewater into the environment, which is environmentally friendly. Furthermore, the claimed subject matter also efficiently cleans garbage bins at the curb and returns it to the curb, thereby increasing throughput and reducing physical labor.

FIG. 1A is a drawing depicting a block diagram of the power takeoff driven pressure washing system 100 of the vehicle-mounted garbage bin cleaning system 150, according to an example embodiment. FIG. 1A shows that the power takeoff driven pressure washing system 100 of the vehicle-mounted garbage bin cleaning system comprises a power washing system 108 connected to a transmission 104 of the vehicle 110 via a power takeoff connection 106. A power take-off or power takeoff (PTO) is any of several methods for taking power from a power source, such as a running engine, and transmitting it to an attached implement or separate machine. In a preferred embodiment, a splined drive shaft extends from the transmission 104 of the vehicle 1100, such as an industrial truck, and mating fittings on an attached power takeoff driven pressure washing system 100 (i.e., the PTO connection 106) allow the power takeoff driven pressure washing system 100 to be powered directly by the transmission of the engine.

The transmission 104 may have one or more locations which allow for the power takeoff connection to be mounted. The power takeoff may be engaged/disengaged using the main transmission clutch and/or a remote-control mechanism which operates on the power takeoff connection itself. An air valve may be used to engage the power takeoff connection, but a mechanical linkage, electric or hydraulic mechanism are also options. The power takeoff may connect directly to a hydraulic pump (described more fully below). This allows for transmission of mechanical force through the hydraulic fluid system to any location around the vehicle where a hydraulic motor will convert it back into rotary or linear mechanical force.

Figure 1B:
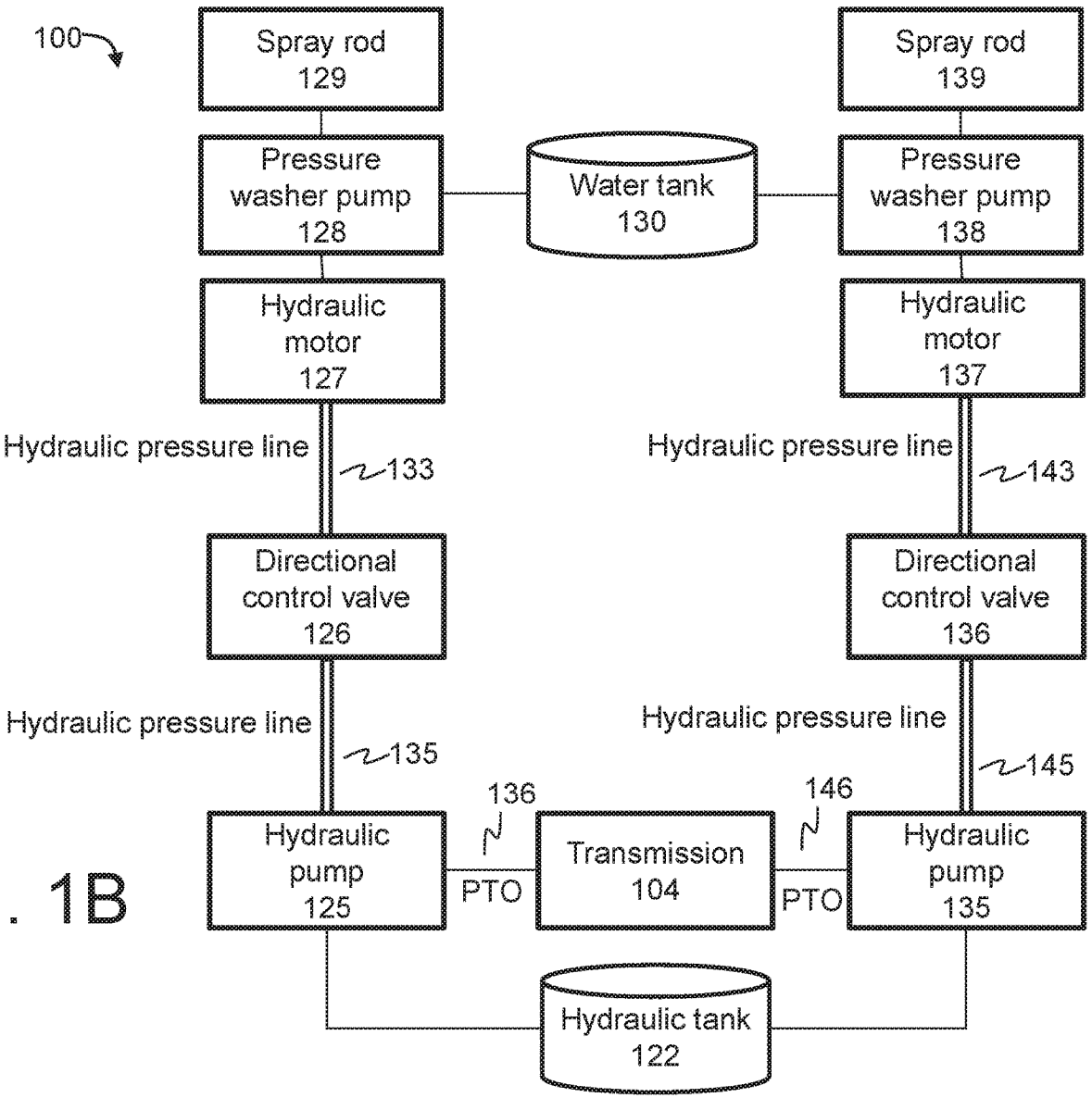
FIG. 1B is a drawing depicting a more detailed block diagram of the power takeoff driven pressure washing system of the vehicle-mounted garbage bin cleaning system, according to an example embodiment.

FIG. 1B is a drawing depicting a more detailed block diagram of the power takeoff driven pressure washing system 100 of the vehicle-mounted garbage bin cleaning system 150, according to an example embodiment. FIG. 1B shows that the power takeoff driven pressure washing system 100 includes at least a first hydraulic pump 125 mechanically coupled to the transmission 104 via a PTO connection 136, and optionally a second hydraulic pump 135 mechanically coupled to the transmission 104 via a PTO connection 146.

A hydraulic pump is a mechanical source of power that converts mechanical power into hydraulic energy (hydrostatic energy i.e. flow, pressure). It generates flow with enough power to overcome pressure induced by the load at the pump outlet. When a hydraulic pump operates, it creates a vacuum at the pump inlet, which forces liquid from the reservoir into the inlet line to the pump and by mechanical action delivers this liquid to the pump outlet and forces it into the hydraulic system. Hydraulic pumps are used in hydraulic drive systems and can be hydrostatic or hydrodynamic. The hydraulic pump may be a gear, rotary vane, screw, bent axis, inline axial piston, radial piston, or peristaltic pump.

The power takeoff driven pressure washing system 100 may be a hydraulic drive system, which is a quasi-hydrostatic drive or transmission system that uses pressurized hydraulic fluid to power hydraulic machinery. The term hydrostatic refers to the transfer of energy from pressure differences, not from the kinetic energy of the flow.

The power takeoff driven pressure washing system 100 may be an open hydraulic system. In this case, the hydraulic pumps 125, 135 draws oil from a reservoir or hydraulic tank 122 at atmospheric pressure. In case of a closed system, both sides of the hydraulic pumps 125, 135 can be at high pressure. In this case, the reservoir is often pressurized at higher pressure to boost pressure.

FIG. 1B further shows that the power takeoff driven pressure washing system 100 includes at least a first hydraulic motor 127 hydraulically coupled (via hydraulic pressure lines 133, 135) to the first hydraulic pump 125, and optionally a second hydraulic motor 137 hydraulically coupled (via hydraulic pressure lines 143, 145) to the second hydraulic pump 135. A hydraulic motor is a mechanical actuator that converts hydraulic pressure and flow into torque and angular displacement (rotation). A hydraulic motor may run on hydraulic fluid as part of an open or closed hydraulic circuit using modern hydraulic machinery. The hydraulic motors 127, 137 may be a vane, gear, gerotor, axial plunger or radial piston motor. Hydraulic pressure lines are conduits (usually flexible) that hold and transport hydraulic fluid so as to hydraulically couple different hydraulic elements in a hydraulic circuit.

FIG. 1B further shows that the power takeoff driven pressure washing system 100 includes at least a first directional control valve 126 situated between the first hydraulic motor 127 and the first hydraulic pump 125, and optionally a second directional control valve 136 situated between the second hydraulic motor 137 and the second hydraulic pump 135. A directional control valve is a hydraulic valve that allows hydraulic fluid flow into different paths from one or more sources. The directional control valve may consist of a spool inside a cylinder which is mechanically or electrically actuated. The position of the spool restricts or permits flow; thus, it controls the fluid flow. The directional control valves 126, 136 allows for the changing of direction of flow of hydraulic fluid into and out of the hydraulic motors 127, 137, so as to change the direction of operation of said motors.

FIG. 1B further shows that the power takeoff driven pressure washing system 100 includes at least a first pressure washer pump 128 mechanically coupled to the first hydraulic motor 127, and optionally a second pressure washer pump 138 mechanically coupled to the second hydraulic motor 137. One, two or more spray rods 129 are fluidically coupled to the pressure washer pump 128, and one, two or more spray rods 139 are fluidically coupled to the pressure washer pump 138. A pressure washer pump is a water pump configured to pump water at high pressures suitable for pressure washing. A water pump is a device that moves water by mechanical action. The water pump may be a direct lift, positive displacement, impulse, velocity, gravity, steam or valveless water pump. The water pump transports water from the reservoir or water tank 130 at high pressure to the spray heads.

FIG. 1B shows that the power takeoff driven pressure washing system 100 can be used to power more than one pressure washing pumps 128, 138 to expel high pressure water jets from more than one set of spray rods 129, 139. As a result, the power takeoff driven pressure washing system 100 can be used to pressure clean more than one garbage bins at once, using the multiple sets of spray rods 129, 139 at the same time. This feature increases the throughput of the system 100, in addition to increasing the volume of garbage bins that can be washed in a given period of time.

Figure 1C:
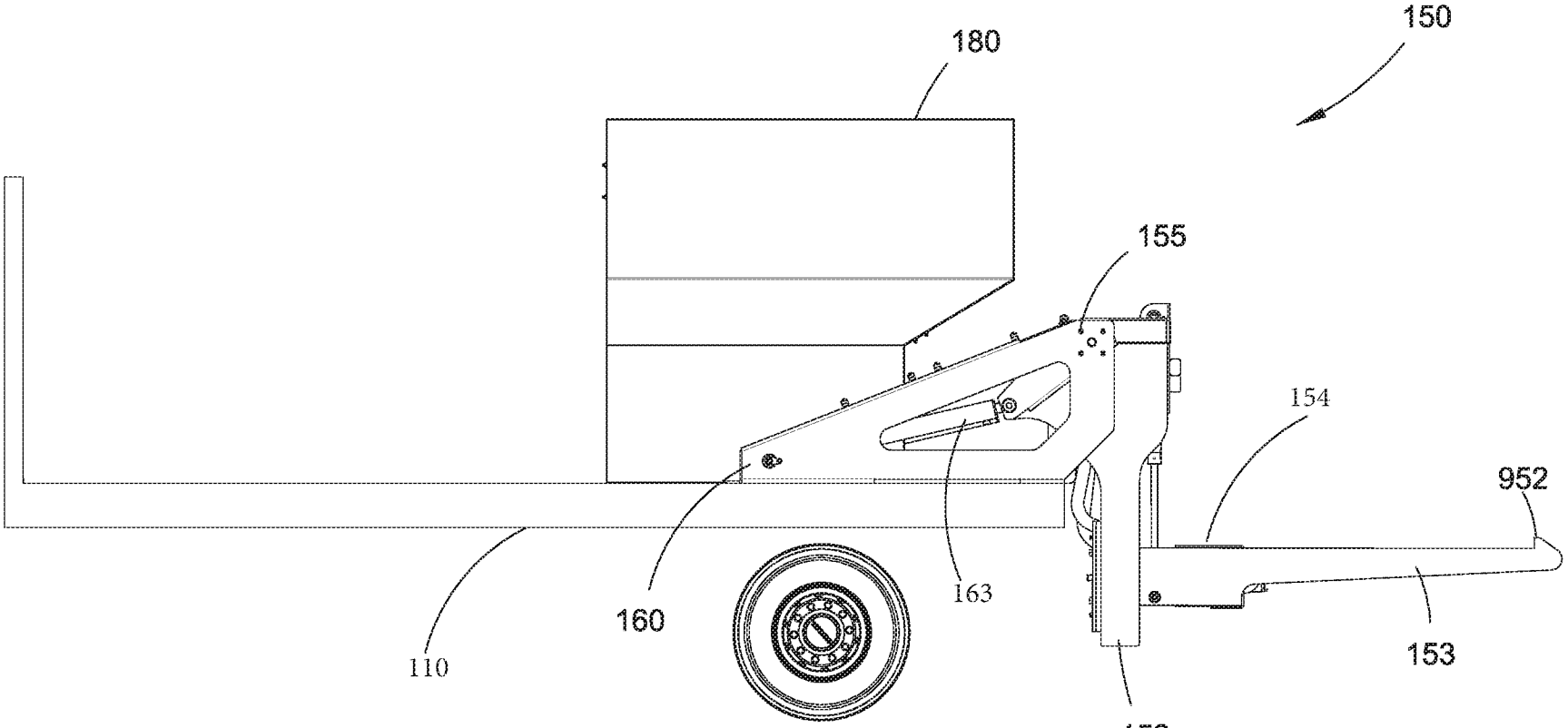
FIG. 1C is a drawing depicting a side view of the vehicle-mounted garbage bin cleaning system including power takeoff, showing the small arms and large arms in the down position, according to an example embodiment.

FIG. 1C is a drawing depicting a side view of the vehicle-mounted garbage bin cleaning system 150 including power takeoff, showing the small arms 154 and large arms 153 in the down position, according to an example embodiment. In FIG. 1C, the small arms 154 are obstructed by the large arms 153. The vehicle-mounted garbage bin cleaning system 150 may be coupled to the trailer element 110 of a vehicle, such as an industrial truck. The vehicle-mounted garbage bin cleaning system 150 includes a first pair of arms 153 (otherwise referred to as the large arms 153) configured for lifting a first garbage bin 402 (otherwise referred to as a large garbage bin 402), such as a dumpster. Said dumpster may measure approximately 2, 4, 6, 8 or 10 cubic yards in volume, 70-85 inches wide, 45-95 inches high and 39-75 inches deep.

The large arms 153 may be coupled to a pair of piston-activated levers 152 that are themselves rotatably coupled to a mount 160 on the vehicle via a hinge 155. The mount 160 may comprise a pair of triangular elements located on either side of the trailer bed 110. The topmost vertex of the triangular elements comprise the hinge 155. The triangular elements may be coupled via a cross bar 917 that extends horizontally to connect the pair of triangular elements. The mount 160 may also comprise further structure between the two triangular elements, to which the levers 152, large arms 153 and small arms 154 are attached. The large arms 153 may be placed in the up position while the vehicle is moving, for safety purposes.

The pair of piston-activated levers 152 are moved up and down into the up position and down position via a pair of hydraulic pistons 163. The pair of piston-activated levers 152 comprise a hinge point 517, to which a piton is attached. The hinge point 517 is located below a fulcrum of the levers 152, which is the hinge 155. When the pistons 163 are extended, they push the hinge point 517 forward, which forces the levers 152 to pivot or rotate around the fulcrum (i.e., the hinge 155). This action rotates the levers substantially 90 to 180 degrees into the up position, so as to turn the garbage bin 202 or 402 substantially upside down or nearly upside down. When the pistons 163 are retracted, the hinge point falls back down, which forces the levers 152 to pivot or rotate around the fulcrum (i.e., the hinge 155), back to the down position.

The vehicle-mounted garbage bin cleaning system 150 further comprises a hopper 180 configured for accepting the large garbage bin 402 when the large arms 153 lift the large garbage bin into the hopper 180.

The vehicle-mounted garbage bin cleaning system 150 further comprises a second pair of arms 154 (otherwise referred to as the small arms 154) configured for lifting a second garbage bin 202 (otherwise referred to as a small garbage bin 202), such as a 35-95-gallon recycling bin. Said small garbage bin 202 may measure approximately 35-95 gallons in volume, 20-29 inches wide, 38-45 inches high and 23-34 inches deep. Note that said small garbage bin 202 is smaller than the large garbage bin 402.

The small arms 154 may be rotatably coupled to the mount 160 on the vehicle via the hinge 155. Note that the small arms 154 are mounted to the pair of levers 152 in between the large arms 153. This allows the small arms 154 to operate while the large arms 153 are in either the up or down position, since the small arms may move up and down in between the large arms without being obstructed by the large arms. Note also that in FIG. 1C, the small arms 154 and the large arms 153 are in the down position, meaning that the small arms 154 and the large arms 153 are extended as far downwards as possible. In the down position, small arms 154 and the large arms 153 are ready and prepared to take hold or grab a garbage bin, as explained in greater detail below.

Note that although FIG. 1C shows only one pair of small arms 154 and one pair of large arms 153, the claimed subject matter supports an implementation that includes two or three pairs of small arms 154 and/or two or three pair of large arms 153. In an embodiment wherein the system 100 includes, for example, two pairs of small arms 154, each pair of small arms is configured to allow for two small garbage bins 202 to be raised and lifted into the hopper 180 for pressure cleaning at the same time. In an embodiment wherein the system 100 includes, for example, two pairs of large arms 153, each pair of large arms is configured to allow for two large garbage bins 402 to be raised and lifted into the hopper 180 for pressure cleaning at the same time.

Figure 6:
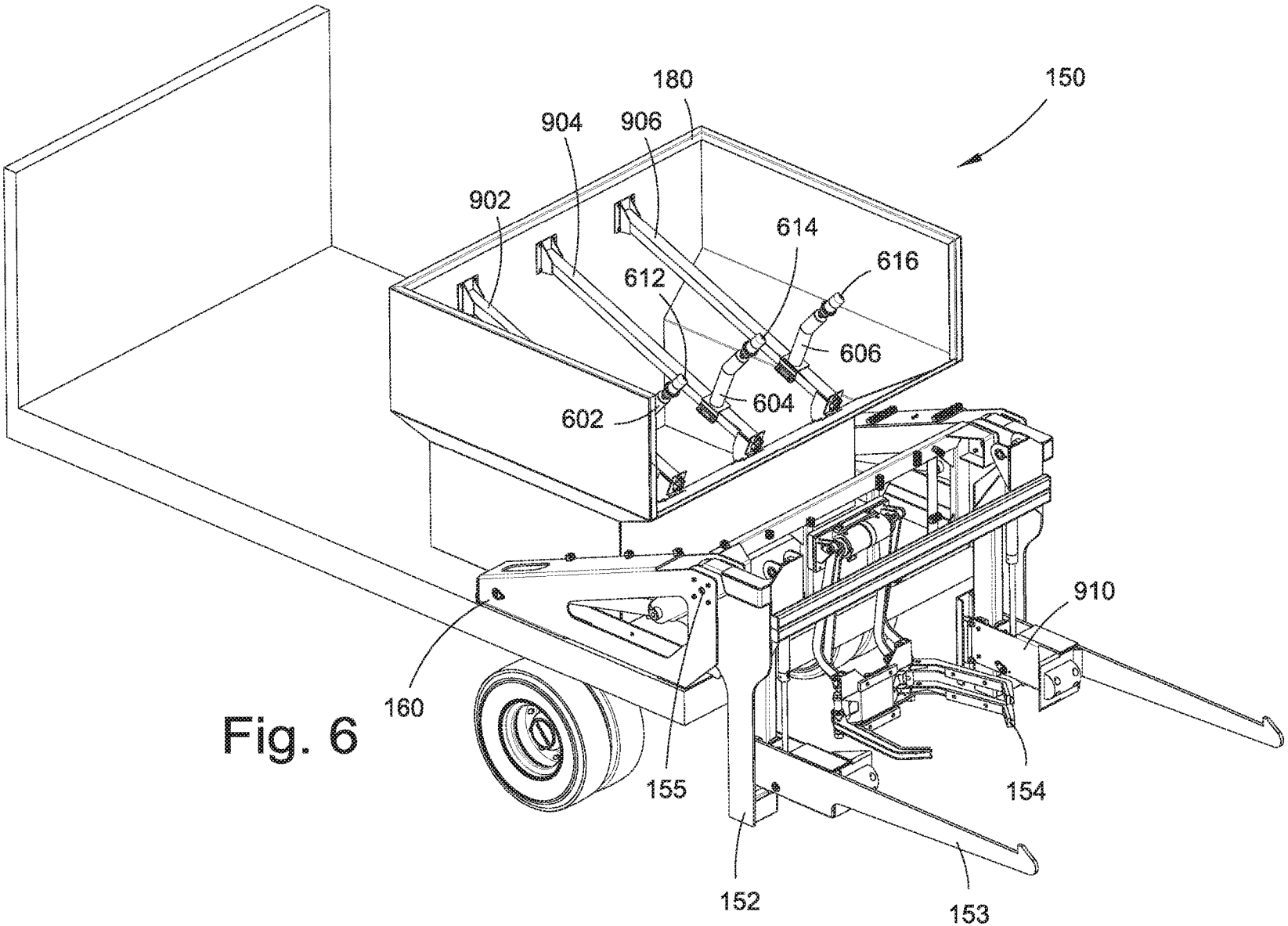
FIG. 6 is a drawing depicting a perspective rear view of the vehicle-mounted garbage bin cleaning system including power takeoff, showing the small arms and large arms in the down position, according to an example embodiment.

Similar to FIG. 1C, FIG. 6 is a drawing depicting a perspective rear view of the vehicle-mounted garbage bin cleaning system 150 including power takeoff, showing the small arms 154 and large arms 153 in the down position, according to an example embodiment. FIG. 6 shows that in the down position, the small arms 154 are coupled to the levers 152 in between the large arms 153, which allows the small arms 154 to operate while the large arms 153 are in either the up or down position. FIG. 6 also shows at least three spray rods 602, 604, 606 extending upwards from the hopper 180, each spray rod including at least one high-pressure, rotating water nozzle 612, 614, 616 that sprays a water jet. In another embodiment, each spray rod includes a plurality of high-pressure, rotating water nozzles that spray water jets.

Figure 2:
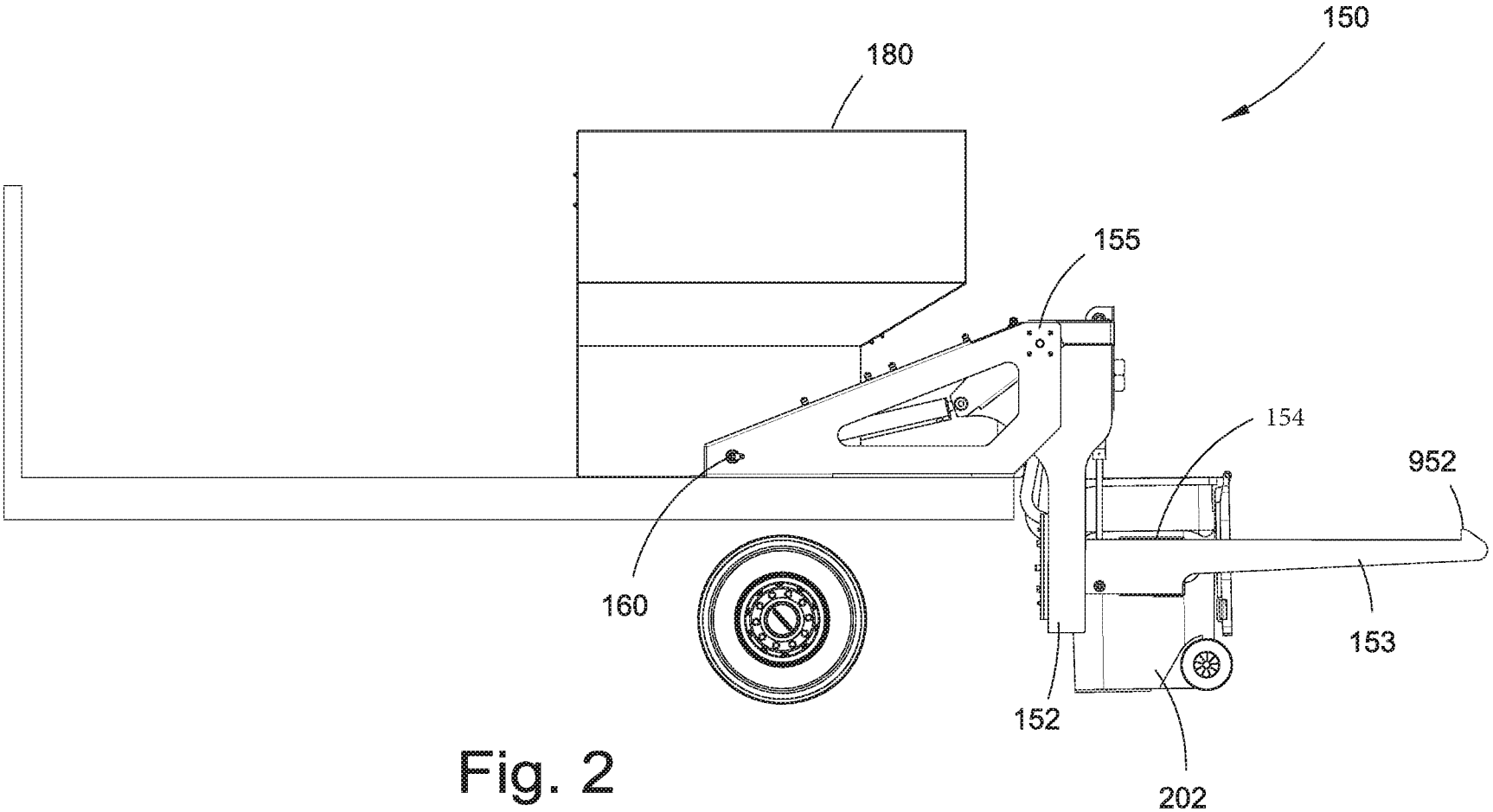
FIG. 2 is a drawing depicting a side view of the vehicle-mounted garbage bin cleaning system including power takeoff, showing the small arms and large arms in the down position, and a small garbage bin in the small arms, according to an example embodiment.

FIG. 2 is a drawing depicting a side view of the vehicle-mounted garbage bin cleaning system 150 including power takeoff, showing the small arms 154 and large arms 153 in the down position, and a small garbage bin 202 in the small arms, according to an example embodiment. In FIG. 2, the small arms 154 are obstructed by the large arms 153. Recall that in the down position, the small arms 154 and the large arms 153 are ready and prepared to take hold or grab a garbage bin. FIG. 2 shows that in the down position, the small arms 154 have opened and grabbed the small garbage bin 202.

Figure 3:
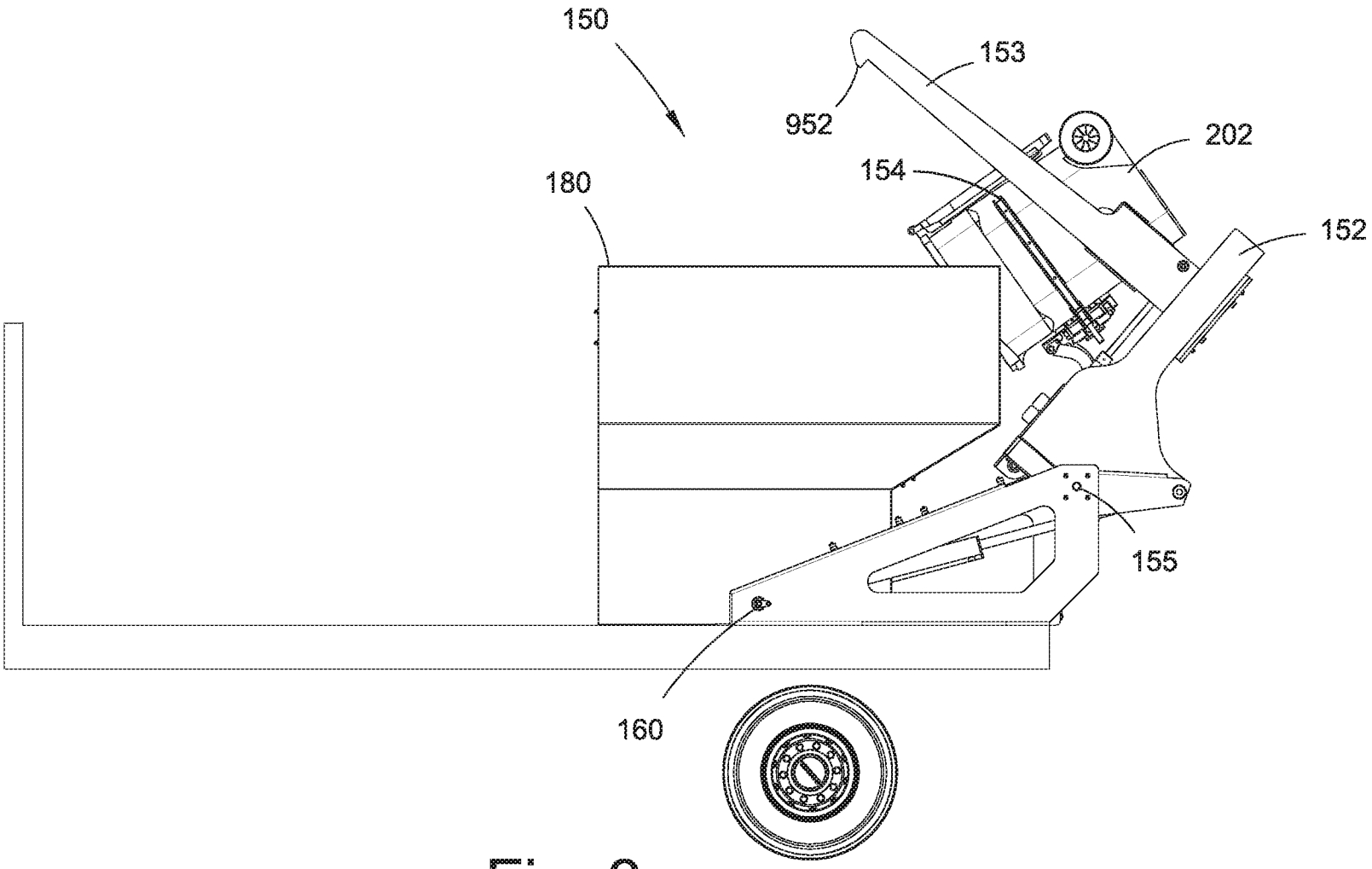
FIG. 3 is a drawing depicting a side view of the vehicle-mounted garbage bin cleaning system including power takeoff, showing the large arms in the up position and the small arms in the up position emptying the small garbage bin, according to an example embodiment.

FIG. 3 is a drawing depicting a side view of the vehicle-mounted garbage bin cleaning system 150 including power takeoff, showing the large arms 153 in the up position and the small arms 154 in the up position emptying the small garbage bin 202, according to an example embodiment. In the up position, small arms 154 have turned the garbage bin 202 substantially upside down, so as to make it easier to clean the interior of the garbage bin, as explained in greater detail below. In the up position, the small arms 154 have rotated substantially 90 to 180 degrees, so as to turn the garbage bin 202 substantially upside down or nearly upside down. Note that the levers 152 have also rotated substantially 90 to 180 degrees about hinge 155. Note that the small arms 154 can move between the up and down positions while being situated between the large arms 153, since the small arms may move up and down in between the large arms without being obstructed by the large arms.

Figure 7:
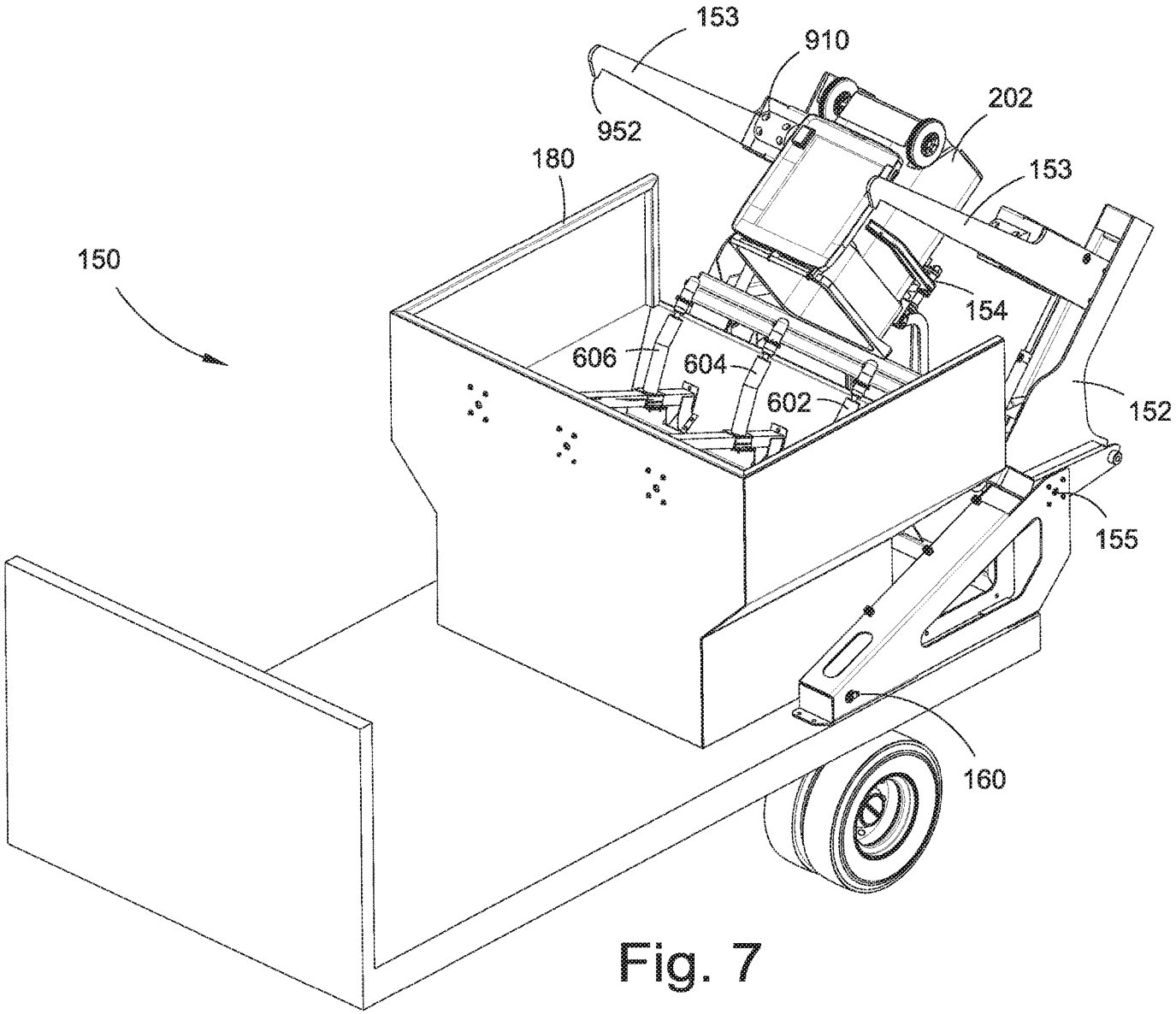
FIG. 7 is a drawing depicting a perspective rear view of the vehicle-mounted garbage bin cleaning system including power takeoff, showing the large arms in the up position and the small arms in the up position emptying the small garbage bin, according to an example embodiment.

Similar to FIG. 3, FIG. 7 is a drawing depicting a perspective rear view of the vehicle-mounted garbage bin cleaning system 150 including power takeoff, showing the large arms 153 in the up position and the small arms 154 in the up position emptying the small garbage bin 202, according to an example embodiment. FIG. 7 shows that in the up position, the small arms 154 are still located in between the large arms 153, which allows the small arms 154 to operate between the large arms 153. The small arms 154 can change between the up and down positions while the large arms 153 remain in the up position. FIG. 7 also shows the hopper 180 configured for accepting the small garbage bin 202 when the small arms 154 lift the small garbage bin 202 into the hopper 180. The hopper 180 is configured to catch substantially all water that is sprayed into the small garbage bin 202 by the at least three spray rods, described in greater detail below. FIG. 7 also shows that when the small arms 154 lift the small garbage bin 202 into the hopper 180, one or more of the at least three spray rods 602, 604, 606 may be situated within the small garbage bin 202 (or near the opening of the small garbage bin) so as to wash and clean the interior thereof with the corresponding rotating water nozzles 612, 614, 616 that spray water jets.

In an embodiment wherein the system 100 includes, for example, two pairs of small arms 154, each pair of small arms is configured to allow for two small garbage bins 202 to be raised and lifted into the hopper 180 for pressure cleaning by the at least three spray rods 602, 604, 606 at the same time.

Figure 4:
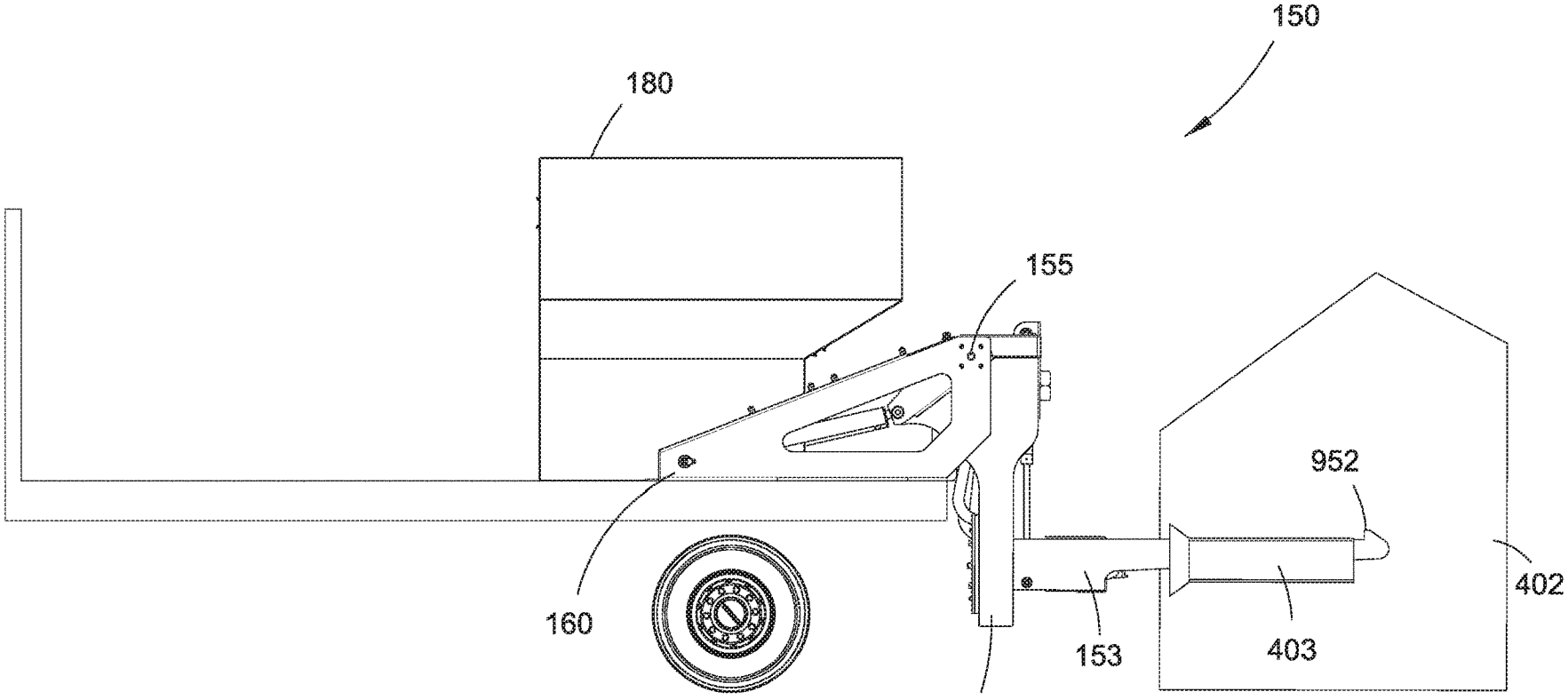
FIG. 4 is a drawing depicting a side view of the vehicle-mounted garbage bin cleaning system including power takeoff, showing the small arms and large arms in the down position, and a large garbage bin in the large arms, according to an example embodiment.

FIG. 4 is a drawing depicting a side view of the vehicle-mounted garbage bin cleaning system 150 including power takeoff, showing the small arms 154 and large arms 153 in the down position, and a large garbage bin 402 in the large arms, according to an example embodiment. Recall that in the down position, the small arms 154 and the large arms 153 are ready and prepared to take hold or grab a garbage bin. FIG. 4 shows that in the down position, the large arms 153 have opened and grabbed the large garbage bin 402. This may comprise the large arms being inserted into brackets 403 that are located on the side of the large garbage bin 402.

Figure 5:
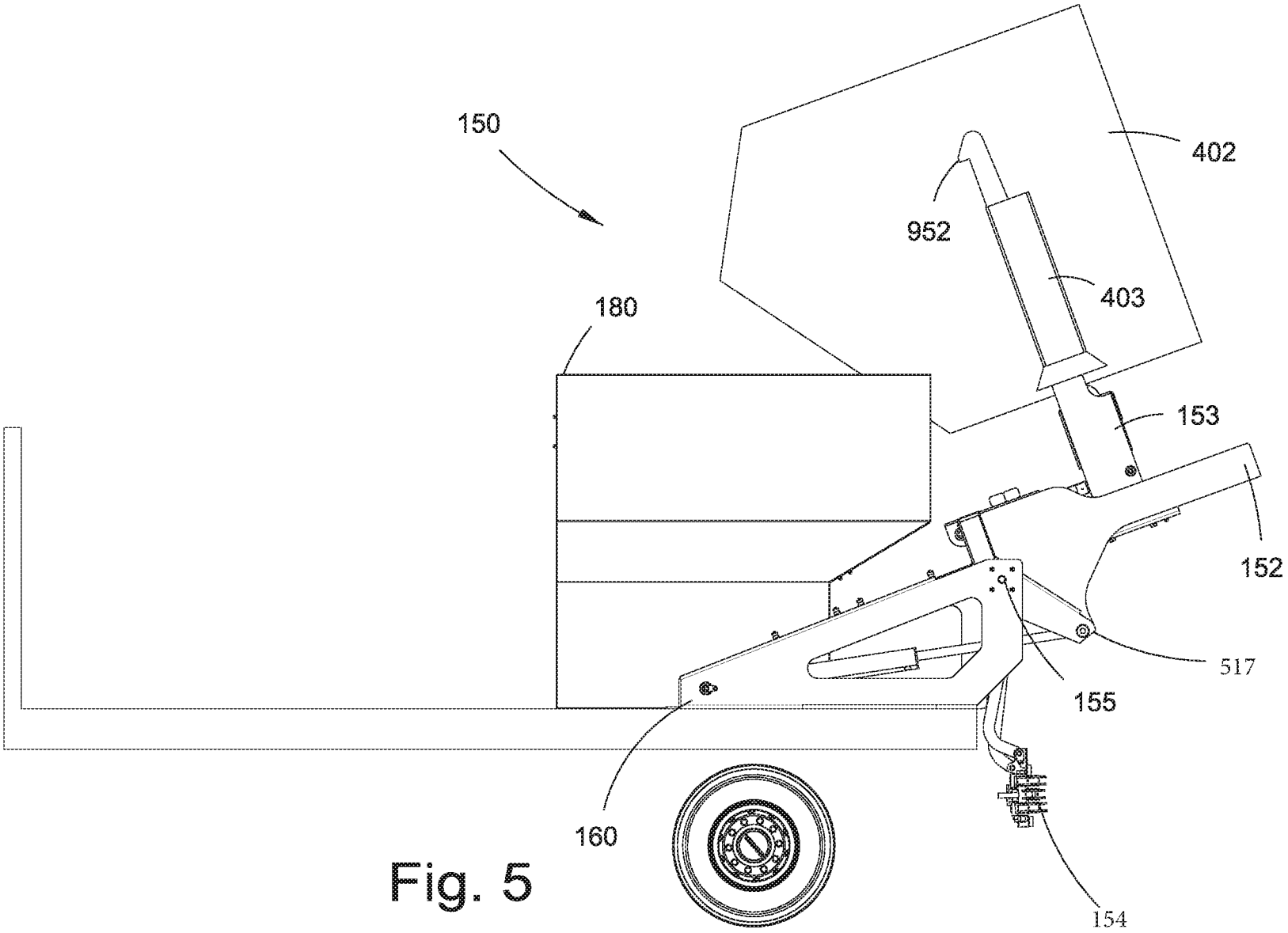
FIG. 5 is a drawing depicting a side view of the vehicle-mounted garbage bin cleaning system including power takeoff, showing the small arms in the down position and the large arms in the up position emptying the large garbage bin, according to an example embodiment.

FIG. 5 is a drawing depicting a side view of the vehicle-mounted garbage bin cleaning system 150 including power takeoff, showing the small arms 154 in the down position and the large arms 153 in the up position emptying the large garbage bin 402, according to an example embodiment. In the up position, large arms 153 have turned the garbage bin 402 substantially upside down or nearly upside down, so as to make it easier to clean the interior of the garbage bin, as explained in greater detail below. In the up position, the large arms 153 have rotated substantially 90 to 180 degrees, so as to turn the garbage bin 402 substantially upside down or nearly upside down. Note that the levers 152 have also rotated substantially 90 to 180 degrees about hinge 155. Further note that the large arms 153 can move between the up and down positions regardless of whether the small arms 154 are in the up or down position. Note also that the large arms 153 can move between the up and down positions without obstructing or interfering with the small arms 154, and the large arms may move up and down around the small arms without being obstructed by the small arms.

Figure 8:
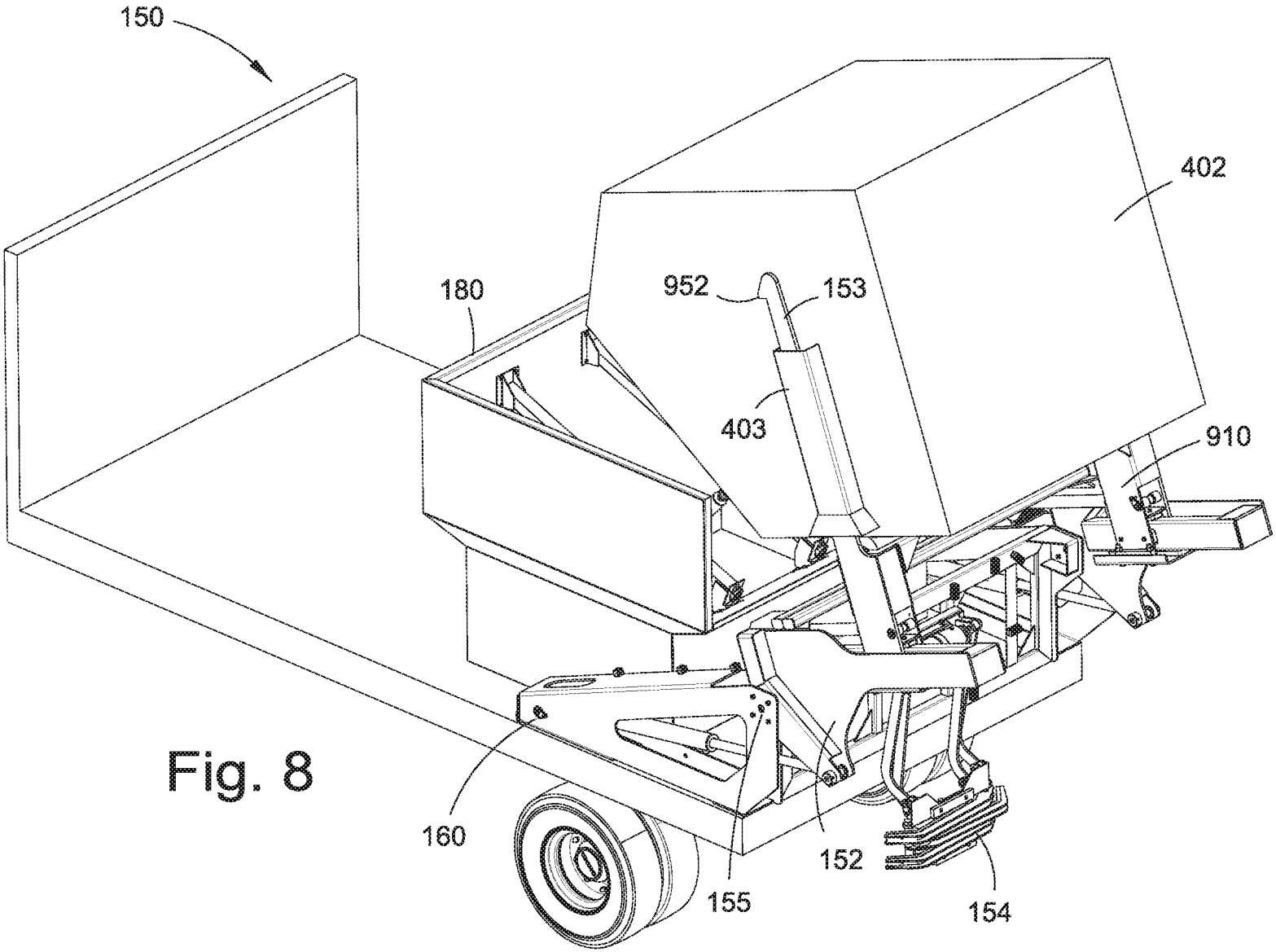
FIG. 8 is a drawing depicting a perspective rear view of the vehicle-mounted garbage bin cleaning system including power takeoff, showing the small arms in the down position and the large arms in the up position emptying the large garbage bin, according to an example embodiment.

Similar to FIG. 5, FIG. 8 is a drawing depicting a perspective rear view of the vehicle-mounted garbage bin cleaning system 150 including power takeoff, showing the small arms 154 in the down position and the large arms 153 in the up position emptying the large garbage bin 402, according to an example embodiment. FIG. 8 shows that in the up position, the large arms 153 are still located around the small arms 154, which allows the large arms 153 to operate while the small arms 154 are in the down position. FIG. 8 also shows the hopper 180 configured for accepting the large garbage bin 402 when the large arms 153 lift the large garbage bin 402 into the hopper 180. The hopper 180 is configured to catch substantially all water that is sprayed into the large garbage bin 402 by the at least three spray rods 602, 604, 606, described in greater detail below. FIG. 8 also shows that when the large arms 153 lift the large garbage bin 402 into the hopper 180, the at least three spray rods 602, 604, 606 are situated within the large garbage bin 402 so as to wash and clean the interior thereof with the corresponding rotating water nozzles 612, 614, 616 that spray water jets.

In an embodiment wherein the system 100 includes, for example, two pairs of large arms 153, each pair of large arms is configured to allow for two large garbage bins 402 to be raised and lifted into the hopper 180 for pressure cleaning by the at least three spray rods 602, 604, 606 at the same time.

Figure 9:
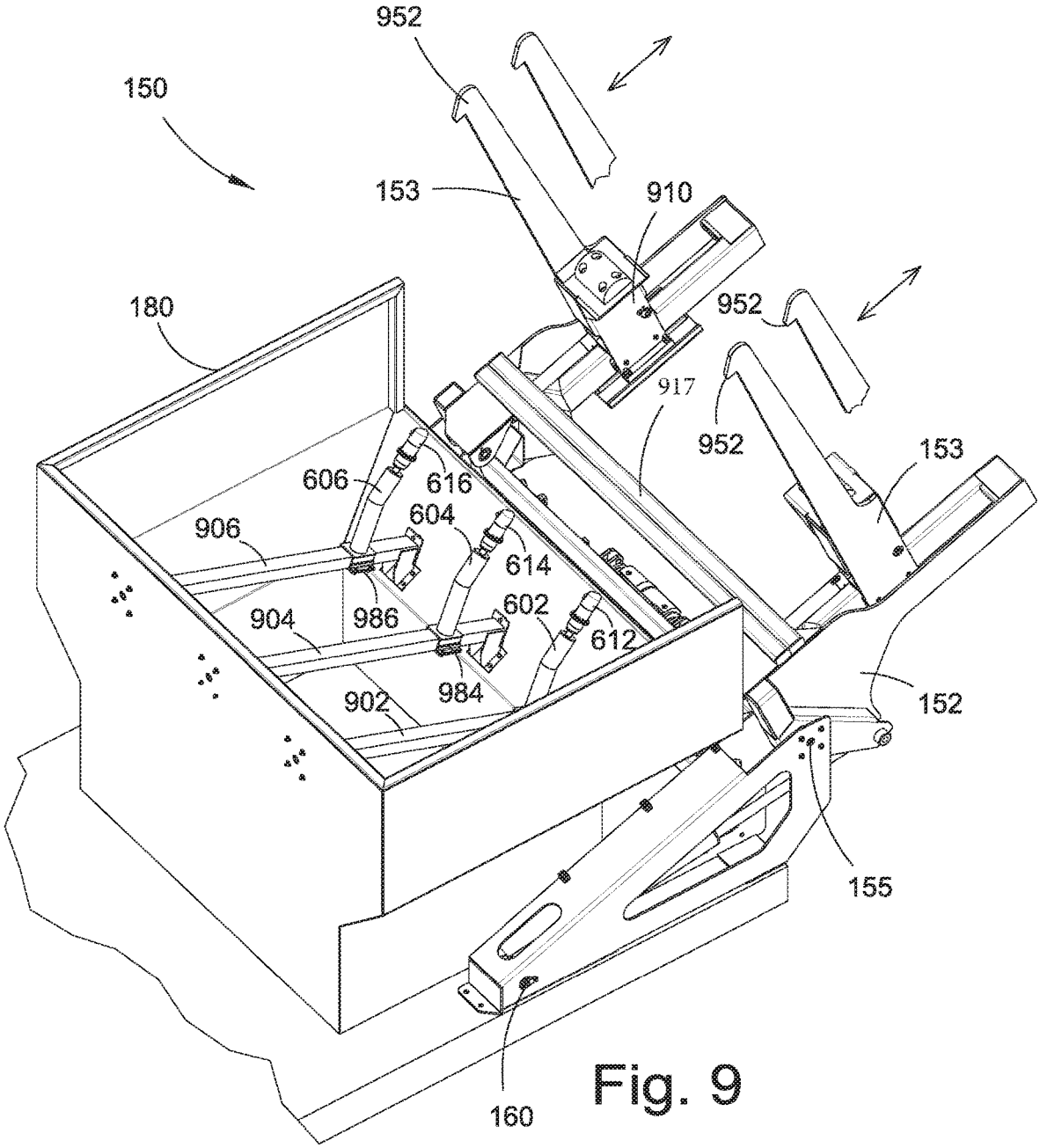
FIG. 9 is a drawing depicting a perspective view of the vehicle-mounted garbage bin cleaning system including power takeoff, according to an example embodiment.

FIG. 9 is a drawing depicting a perspective view of the vehicle-mounted garbage bin cleaning system 150 including power takeoff, according to an example embodiment. FIG. 9 shows that each arm of the large arms 153 is configured for insertion into brackets 403 in the large garbage bin 402. Specifically, the end of each arm 153 includes a hook element 952 that prevents the bracket 403 from sliding off the arm 153, when the arm 153 is inserted fully into the bracket 403 (see FIG. 4). The hook element includes an element that extends perpendicularly from the main longitudinal axis of the arm, so as to provide an obstruction for the bracket 403 sliding off the arm 153.

FIG. 9 also shows that each arm 153 is attached to a base 910 that may slide along a lever 152. FIG. 9 includes arrows that indicate the direction in which the arms 153 move along the levers 152, and also includes partial drawings of the arms 153 that show the arms in different locations along the axis of the levers 152. In one embodiment, the vehicle-mounted garbage bin cleaning system 150 includes a hydraulic based system that moves the base 910 along the lever 152, so as to move the arm 153 up and down the lever 152. Thus, both of the large arms 153 are slidably connected to the lever 152. In one embodiment, when the large arms 153 lift the large garbage bin 402 into the hopper 180, the large arms 153 slidably move the large garbage bin 402 towards the hopper by moving the arms 153 down the lever 152 toward the hopper. This allows for better access of the spraying rods to the interior of the garbage bin. Thus, when the large arms 153 lift the large garbage bin 402 into the hopper 180, and the arms 153 move along the lever 152 to bring the garbage bin closer to the hopper, the at least three spray rods 602, 604, 606 are situated within the large garbage bin 402 so as to wash and clean the interior thereof with the corresponding rotating water nozzles 612, 614, 616 that spray water jets.

Figure 10:
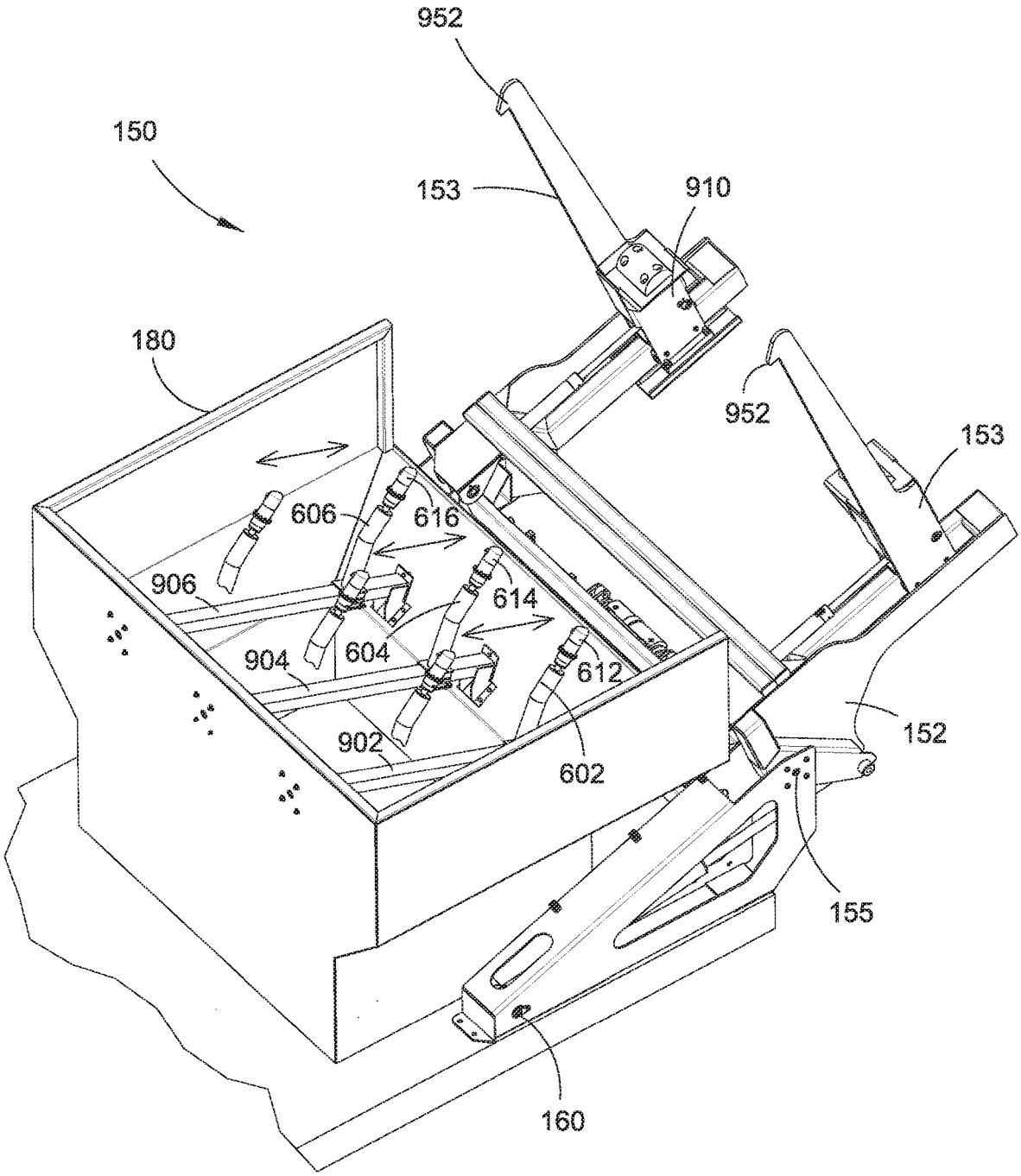
FIG. 10 is a drawing depicting another perspective view of the vehicle-mounted garbage bin cleaning system including power takeoff, according to an example embodiment.

FIG. 10 is a drawing depicting another perspective view of the vehicle-mounted garbage bin cleaning system 150 including power takeoff, according to an example embodiment. FIG. 10 shows that the water jet system includes an electrically activated system that moves each spray rod 602, 604, 606 along a corresponding axis 902, 904, 906 to optimally position the spray rod within a garbage bin. Each axis 902, 904, 906 is a straight bar or beam that extends from one end of the interior of the hopper to the other end of the hopper. FIG. 10 includes arrows that indicate the direction in which the spray rods move along the axes, and also includes partial drawings of the spray rods that show the spray rods in different locations along the axes. Not that each spray rod may move individually and separately from all other spray rods.

FIG. 10 shows that the spray rods 602, 604, 606 extend upwards from the hopper 180 and include a high-pressure, rotating water nozzles 612, 614, 616. In one embodiment, each spray rod includes a plurality of high-pressure, rotating water nozzles that spray water jets. FIG. 10 shows that each spray rod 602, 604, 606 is attached to a base (such as 984, 986) that may slide along a corresponding axis (such as 904, 906, respectively). In one embodiment, the vehicle-mounted garbage bin cleaning system 150 includes an electrical based system that moves the base (such as 984, 986) along the axis, so as to move the corresponding spray rod along the axis, and optimally position the spray rod within the garbage bin for maximum cleaning effect. Each of the at least three spray rods 602, 604, 606 are coupled to a base (such as 984, 986), which are slidably connected to a corresponding axis (such as axes 902, 904, 906).

When the large arms 153 lift the large garbage bin 402 into the hopper 180, the at least three spray rods 602, 604, 606 are situated within the large garbage bin 402, and each of the at least three spray rods are moved by the electrical based system along a corresponding axis (such as axes 902, 904, 906) to be optimally positioned within the large garbage bin 402 for maximum cleaning effect. When the small arms 154 lift the small garbage bin 202 into the hopper 180, one or more of the at least three spray rods 602, 604, 606 are situated within the small garbage bin 202, and each of said one or more spray rods are moved along a corresponding axis by the electrical based system to be optimally positioned within the small garbage bin for maximum cleaning effect.

In one embodiment, the vehicle-mounted garbage bin cleaning system 150 may further include an electrically activated system configured for spraying a liquid disinfectant into the large or small garbage bins 202, 402 when the garbage bin is in the hopper 180. Disinfectants are antimicrobial agents that are applied to the interior of the large or small garbage bins 202, 402 to destroy microorganisms that are living in the large or small garbage bins 202, 402.

In another embodiment, the vehicle-mounted garbage bin cleaning system 150 may further include a control panel for controlling the large arms 153, the small arms 154, the water jets sprayed by the at least three spray rods 602, 604, 606, and the electrically activated system that moves each of the at least three spray rods 602, 604, 606. The control panel may be a flat and/or vertical area where control or monitoring instruments are displayed and located in an area that users can access. The control panel may be equipped with push buttons and analog instruments, or, alternatively, touchscreens, used for monitoring and control purposes. A user can utilize the control panel to control the up and down positions of the large arms 153, the up and down positions of the small arms 154, whether and when the water jets are sprayed by the at least three spray rods 602, 604, 606, and whether and when the electrically activated system moves each of the at least three spray rods 602, 604, 606 so as to place them in the optimal location within a garbage bin the hopper 180, for optimal cleaning effect.

Figure 11:
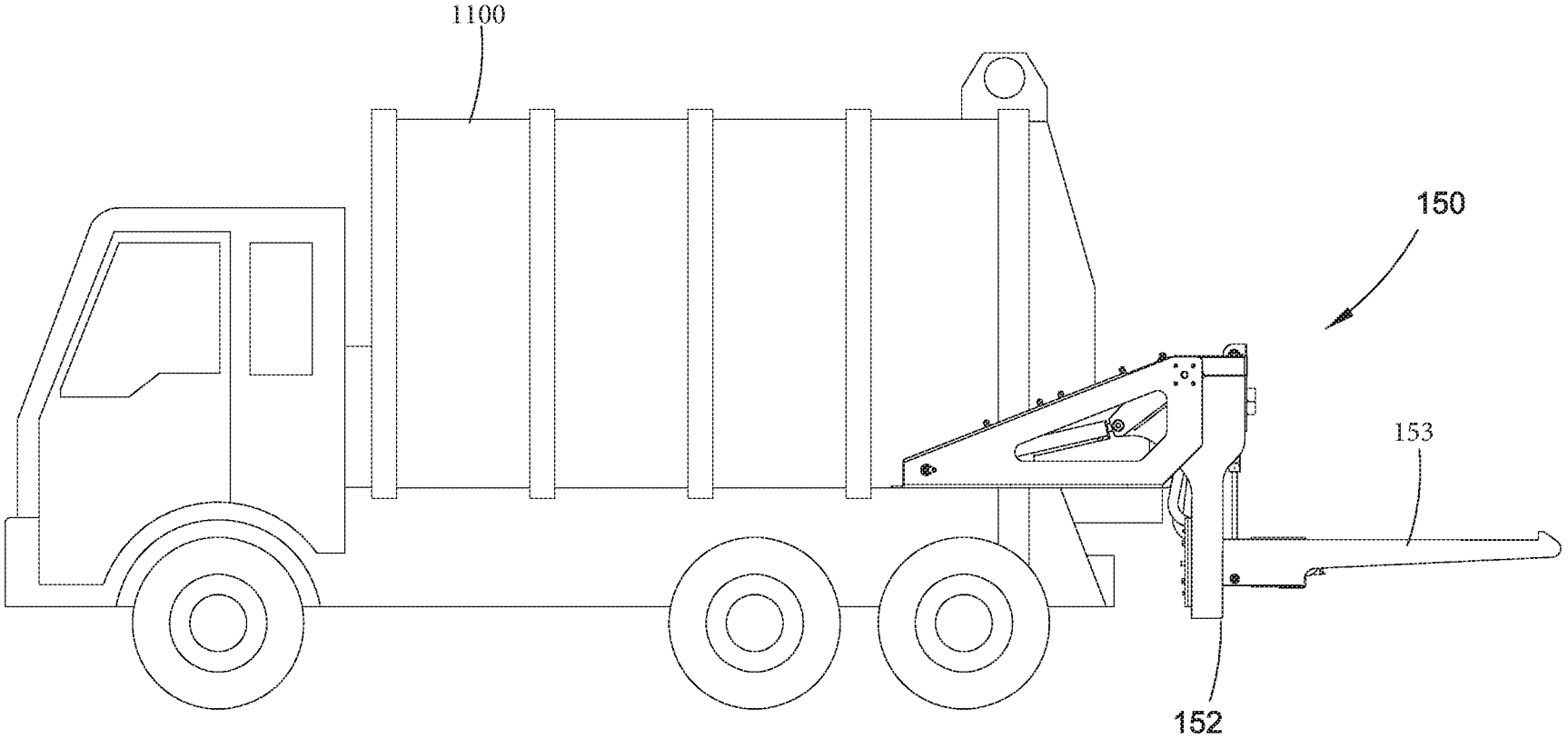
FIG. 11 is a drawing depicting a side view of the vehicle-mounted garbage bin cleaning system including power takeoff, showing the small arms and large arms in the down position, according to an example embodiment.

FIG. 11 is a drawing depicting a side view of the vehicle-mounted garbage bin cleaning system 150 including power takeoff, showing the large arms 153 in the down position, according to an example embodiment. The vehicle-mounted garbage bin cleaning system 150 may be coupled to the trailer 110 of a vehicle 1100, such as an industrial truck.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A vehicle-mounted garbage bin cleaning system including power takeoff, the system comprising:

a) a pair of arms configured for lifting a garbage bin, the pair of arms rotatably coupled to a mount on a vehicle;

b) a hopper configured for accepting the garbage bin when the pair of arms lifts the garbage bin into the hopper;

c) at least one spray rod extending upwards from the hopper, the at least one spray rod including a longitudinal axis extending from a base to at least one high-pressure, rotating water nozzle that sprays a water jet;

d) wherein when the pair of arms lifts the garbage bin into the hopper, the at least one spray rod is situated within the garbage bin, the at least one spray rod being movably attached to a beam that is substantially perpendicular to the longitudinal axis, such that the at least one spray rod moves along the beam; and e) a power takeoff driven pressure washing system comprising:

1) a hydraulic pump mechanically coupled with a transmission of the vehicle, such that the transmission drives the hydraulic pump;

2) a hydraulic motor hydraulically coupled with the hydraulic pump, such that the hydraulic pump drives the hydraulic motor;

3) a pressure washer pump mechanically coupled to the hydraulic motor such that the hydraulic motor drives the pressure washer pump; and 4) the at least one spray rod fluidically coupled with the pressure washer pump such that pressure washer pump provides pressurized water to the at least one spray rod.

2. The vehicle-mounted garbage bin cleaning system of claim 1, wherein the power takeoff pressure washing system comprises an open loop hydraulic system.

3. The vehicle-mounted garbage bin cleaning system of claim 2, wherein the power takeoff pressure washing system further comprises a hydraulic tank that feed hydraulic fluid to the hydraulic pump.

4. The vehicle-mounted garbage bin cleaning system of claim 3, wherein the power takeoff pressure washing system further comprises a hydraulic directional control valve coupled to the hydraulic pump and the hydraulic motor, so as to control the direction of hydraulic fluid through the hydraulic motor.

5. The vehicle-mounted garbage bin cleaning system of claim 1, wherein the hopper is configured to catch substantially all water that is sprayed by the at least one spray rod.

6. The vehicle-mounted garbage bin cleaning system of claim 5, wherein the at least one spray rod includes a plurality of high-pressure, rotating water nozzles that spray water jets.

7. The vehicle-mounted garbage bin cleaning system of claim 6, further comprising a control panel for controlling the pair of arms, and the water jets sprayed by the at least one spray rod.

8. The vehicle-mounted garbage bin cleaning system of claim 1, wherein a water tank provides a source of water to the pressure washer pump.

9. A vehicle-mounted garbage bin cleaning system including power takeoff, the system comprising:

a) a pair of arms configured for lifting a garbage bin, the pair of arms rotatably coupled to a mount on a vehicle;

b) a hopper configured for accepting the garbage bin when the pair of arms lifts the garbage bin into the hopper;

c) at least two spray rods extending upwards from the hopper, each of said spray rods including a longitudinal axis extending from a base to at least one high-pressure, rotating water nozzle that sprays a water jet;

d) wherein when the pair of arms lifts the garbage bin into the hopper, the at least two spray rods are situated within the garbage bin, and wherein each of the at least two spray rods is movably attached to one of a plurality of beams, wherein each beam of the plurality of beams is substantially perpendicular to the longitudinal axis of a corresponding spray rod that moves along said beam; and e) a power takeoff driven pressure washing system comprising:

1) a first hydraulic pump mechanically coupled with a transmission of the vehicle, and a second hydraulic pump mechanically coupled with the transmission, such that the transmission drives the first and second hydraulic pumps;

2) a first hydraulic motor hydraulically coupled with the first hydraulic pump, such that the first hydraulic pump drives the first hydraulic motor, and a second hydraulic motor hydraulically coupled with the second hydraulic pump, such that the second hydraulic pump drives the second hydraulic motor;

3) a first pressure washer pump mechanically coupled to the first hydraulic motor such that the first hydraulic motor drives the first pressure washer pump, and a second pressure washer pump mechanically coupled to the second hydraulic motor such that the second hydraulic motor drives the second pressure washer pump; and 4) a first of the at least two spray rods fluidically coupled with the first pressure washer pump such that first pressure washer pump provides pressurized water to the first of the at least two spray rods, and a second of the at least two spray rods fluidically coupled with the second pressure washer pump such that second pressure washer pump provides pressurized water to the second of the at least two spray rods.

10. The vehicle-mounted garbage bin cleaning system of claim 9, wherein the power takeoff pressure washing system comprises an open loop hydraulic system.

11. The vehicle-mounted garbage bin cleaning system of claim 10, wherein the power takeoff pressure washing system further comprises a hydraulic tank that feed hydraulic fluid to the first and second hydraulic pumps.

12. The vehicle-mounted garbage bin cleaning system of claim 11, wherein the power takeoff pressure washing system further comprises a first hydraulic directional control valve coupled to the first hydraulic pump and the first hydraulic motor, so as to control the direction of hydraulic fluid through the first hydraulic motor, and wherein the power takeoff pressure washing system further comprises a second hydraulic directional control valve coupled to the second hydraulic pump and the second hydraulic motor, so as to control the direction of hydraulic fluid through the second hydraulic motor.

13. The vehicle-mounted garbage bin cleaning system of claim 9, wherein the hopper is configured to catch substantially all water that is sprayed by the at least two spray rods.

14. The vehicle-mounted garbage bin cleaning system of claim 13, wherein each of the at least two spray rods include a plurality of high-pressure, rotating water nozzles that spray water jets.

15. The vehicle-mounted garbage bin cleaning system of claim 14, further comprising a control panel for controlling the pair of arms, and the water jets sprayed by the at least two spray rods.

16. The vehicle-mounted garbage bin cleaning system of claim 9, wherein a water tank provides a source of water to the first and second pressure washer pumps.

17. A vehicle-mounted garbage bin cleaning system including power takeoff, the system comprising:

a) a first pair of arms configured for lifting a first garbage bin, the first pair of arms rotatably coupled to a mount on a vehicle, and a second pair of arms configured for lifting a second garbage bin simultaneously with the first pair of arms, the second pair of arms rotatably coupled to the mount on the vehicle;

b) a hopper configured for accepting the first and second garbage bins when the first and second pair of arms simultaneously lift the first and second garbage bins into the hopper;

c) at least two spray rods extending upwards from the hopper, each of said spray rods including a longitudinal axis extending from a base to at least one high-pressure, rotating water nozzle that sprays a water jet;

d) wherein when the first and second pair of arms simultaneously lift the first and second garbage bin into the hopper, each of said at least two spray rods are situated within either the first or second garbage bins, and wherein each of the at least two spray rods is movably attached to one of a plurality of beams, wherein each beam of the plurality of beams is substantially perpendicular to the longitudinal axis of a corresponding spray rod that moves along said beam; and e) a power takeoff driven pressure washing system comprising:

1) a first hydraulic pump mechanically coupled with a transmission of the vehicle, and a second hydraulic pump mechanically coupled with the transmission, such that the transmission drives the first and second hydraulic pumps;

2) a first hydraulic motor hydraulically coupled with the first hydraulic pump, such that the first hydraulic pump drives the first hydraulic motor, and a second hydraulic motor hydraulically coupled with the second hydraulic pump, such that the second hydraulic pump drives the second hydraulic motor;

3) a first pressure washer pump mechanically coupled to the first hydraulic motor such that the first hydraulic motor drives the first pressure washer pump, and a second pressure washer pump mechanically coupled to the second hydraulic motor such that the second hydraulic motor drives the second pressure washer pump;

4) a first hydraulic directional control valve coupled to the first hydraulic pump and the first hydraulic motor, so as to control the direction of hydraulic fluid through the first hydraulic motor, and wherein the power takeoff pressure washing system further comprises a second hydraulic directional control valve coupled to the second hydraulic pump and the second hydraulic motor, so as to control the direction of hydraulic fluid through the second hydraulic motor; and 5) a first of the at least two spray rods fluidically coupled with the first pressure washer pump such that first pressure washer pump provides pressurized water to the first of the at least two spray rods, and a second of the at least two spray rods fluidically coupled with the second pressure washer pump such that second pressure washer pump provides pressurized water to the second of the at least two spray rods.

18. The vehicle-mounted garbage bin cleaning system of claim 17, wherein the power takeoff pressure washing system comprises an open loop hydraulic system.

19. The vehicle-mounted garbage bin cleaning system of claim 18, wherein the power takeoff pressure washing system further comprises a hydraulic tank that feed hydraulic fluid to the first and second hydraulic pumps.

* * * * *